US007523942B2

(12) United States Patent
Chung

(10) Patent No.: US 7,523,942 B2
(45) Date of Patent: Apr. 28, 2009

(54) CONVERTIBLE GAME ASSEMBLY

(75) Inventor: Safari Chung, Taipei (TW)

(73) Assignee: SOP Services, Inc., Las Vegas, NV (US)

( * ) Notice: Subject to any disclaimer, the term of this patent is extended or adjusted under 35 U.S.C. 154(b) by 0 days.

(21) Appl. No.: 12/100,868

(22) Filed: Apr. 10, 2008

(65) Prior Publication Data

US 2008/0252018 A1 Oct. 16, 2008

Related U.S. Application Data

(60) Provisional application No. 60/911,163, filed on Apr. 11, 2007.

(51) Int. Cl.
*A63B 67/00* (2006.01)

(52) U.S. Cl. ..... 273/317.1; 273/317.3; 273/317.5; 273/348; 273/398; 273/402

(58) Field of Classification Search ..... 273/317, 273/317.1, 317.3, 317.5, 348, 398, 400, 401, 273/402, 371; 473/438, 439, 447, 459, 476–479, 473/465

See application file for complete search history.

(56) References Cited

U.S. PATENT DOCUMENTS

| | | | | | |
|---|---|---|---|---|---|
| D213,209 | S | * | 1/1969 | Zielinksi | D21/305 |
| 4,013,292 | A | * | 3/1977 | Cohen et al. | 273/371 |
| 4,786,053 | A | | 11/1988 | Barnes, Jr. | |
| 5,110,127 | A | | 5/1992 | Potter | |
| 5,257,780 | A | * | 11/1993 | Cook et al. | 273/371 |
| 5,443,259 | A | * | 8/1995 | Segan et al. | 273/352 |
| 5,513,843 | A | | 5/1996 | Russell | |
| 5,558,338 | A | * | 9/1996 | Taub | 473/416 |
| 5,584,480 | A | | 12/1996 | Grimsrud | |
| 5,613,676 | A | | 3/1997 | Connolly | |
| 5,630,760 | A | * | 5/1997 | Brown et al. | 273/108.52 |
| 5,842,699 | A | * | 12/1998 | Mirando et al. | 273/317.3 |
| 5,865,691 | A | | 2/1999 | Chen | |
| 6,070,879 | A | | 6/2000 | Kemp | |
| 6,536,770 | B1 | * | 3/2003 | Yang | 273/317.3 |
| 7,247,105 | B2 | * | 7/2007 | Huntsberger | 473/433 |
| 7,404,562 | B2 | * | 7/2008 | Chen et al. | 273/317.3 |
| 2003/0030218 | A1 | * | 2/2003 | Zucchi et al. | 273/371 |
| 2005/0238419 | A1 | | 10/2005 | Lauridsen | |
| 2006/0154751 | A1 | * | 7/2006 | Huntsberger | 473/433 |
| 2008/0042358 | A1 | * | 2/2008 | Chen et al. | 273/317.3 |

* cited by examiner

*Primary Examiner*—Raleigh W. Chiu
(74) *Attorney, Agent, or Firm*—Woodard, Emhardt, Moriarty, McNett & Henry LLP

(57) ABSTRACT

A convertible game assembly comprises a convertible frame having at least one adjustable joint separating a back frame portion and a front frame portion. The front frame portion is configured to pivot upward and backward about the adjustable joint to convert the frame from an open to a closed configuration. The assembly further includes an elevated back target piece coupled to the back frame portion and a front target piece coupled to the front frame portion. The frame is positionable in an open configuration to allow a game player to throw projectiles toward the back target piece, with the open configuration defining a first player position. Additionally, the frame is positionable in a closed configuration to allow a game player to kick projectiles toward the front target piece, with the closed configuration defining a second player position closer to the back frame portion than the first player position.

20 Claims, 3 Drawing Sheets

CONVERTIBLE GAME ASSEMBLY

CROSS-REFERENCE TO RELATED APPLICATIONS

This application claims the benefit of U.S. Provisional Application No. 60/911,163, filed Apr. 11, 2007, which is hereby incorporated by reference.

FIELD OF THE DISCLOSURE

The present invention relates generally to the field of recreational games, and more specifically provides a convertible game assembly for playing the games of basketball, football and soccer.

BACKGROUND OF THE DISCLOSURE

The sports of basketball, football and soccer are quite popular in the United States and many people enjoy watching or playing these games. To provide standardized games, complex sets of rules have been developed for playing these games. In order to play an actual game, it can sometimes be difficult to find the substantial amount of room needed as well as a sufficient number of players to form two full teams. Other factors, such as weather and the potential for injury, have also been known to make arranging games difficult. Accordingly, there has developed a need and market for indoor or smaller scale games or practice facilities which can be played with less room and require fewer people. Such games can, for example, be set up in basements, garages, game rooms, arcades, gyms, fairs, party facilities or otherwise and preferably can be played in a relatively small area with one or two people. Additionally, it is desirable to convert between these games within one game assembly.

An improved system and method for playing and converting between these games is desired.

SUMMARY OF THE DISCLOSURE

In one embodiment, a convertible game assembly comprises a convertible frame having a back frame portion and a front frame portion and at least one adjustable joint separating the back and front frame portions. The front frame portion is configured to pivot upward about the adjustable joint toward the back frame portion to convert the frame from an open configuration to a closed configuration. The assembly also includes an elevated back target piece coupled to the back frame portion and a front target piece coupled to the front frame portion. The frame is positionable in the open configuration to allow a game player to throw projectiles toward the back target piece, the open configuration defining a first player position in front of the front frame portion. Additionally, the frame is positionable in the closed configuration to allow a game player to kick projectiles toward the front target piece, the closed configuration defining a second player position in front of the front frame portion and closer to the back frame portion than the first player position.

In another embodiment, a convertible game assembly comprises a convertible frame configured to convert between a first configuration for playing a throwing game and a second configuration for playing a kicking game, the first configuration being different from the second configuration. The frame includes a rear base portion and a forward pivoting portion. The assembly further includes a throwing target area engaged with the rear base portion of the frame and a kicking target area engaged with the forward moveable portion of the frame, the second target area being different from the first target area. The frame is positionable in the first configuration for a player to play the throwing game utilizing the throwing target area. Additionally, the frame is positionable in the second configuration by pivoting the forward pivoting portion to orient the kicking target area for a player to play a kicking game.

In yet another embodiment, a system comprises a convertible game assembly for converting between at least one kicking game and at least one throwing game. The assembly includes a convertible frame having two adjustable side joints to convert the frame between throwing and kicking game-playing configurations. The frame includes a back base frame portion and a front pivoting frame portion, with the adjustable side joints positioned between and separating the front and back frame portions. Additionally, the assembly includes a throwing target area engaged with the back base frame portion and having at least one of a basketball goal and a football target for use in playing basketball or football, respectively, when the frame is positioned in the throwing game-playing configuration. The assembly further includes a kicking target area engaged with the front pivoting frame portion and having at least one soccer target for use in playing soccer when the frame is positioned in the kicking game-playing configuration.

DESCRIPTION OF THE ILLUSTRATED EMBODIMENTS

Figure 1:
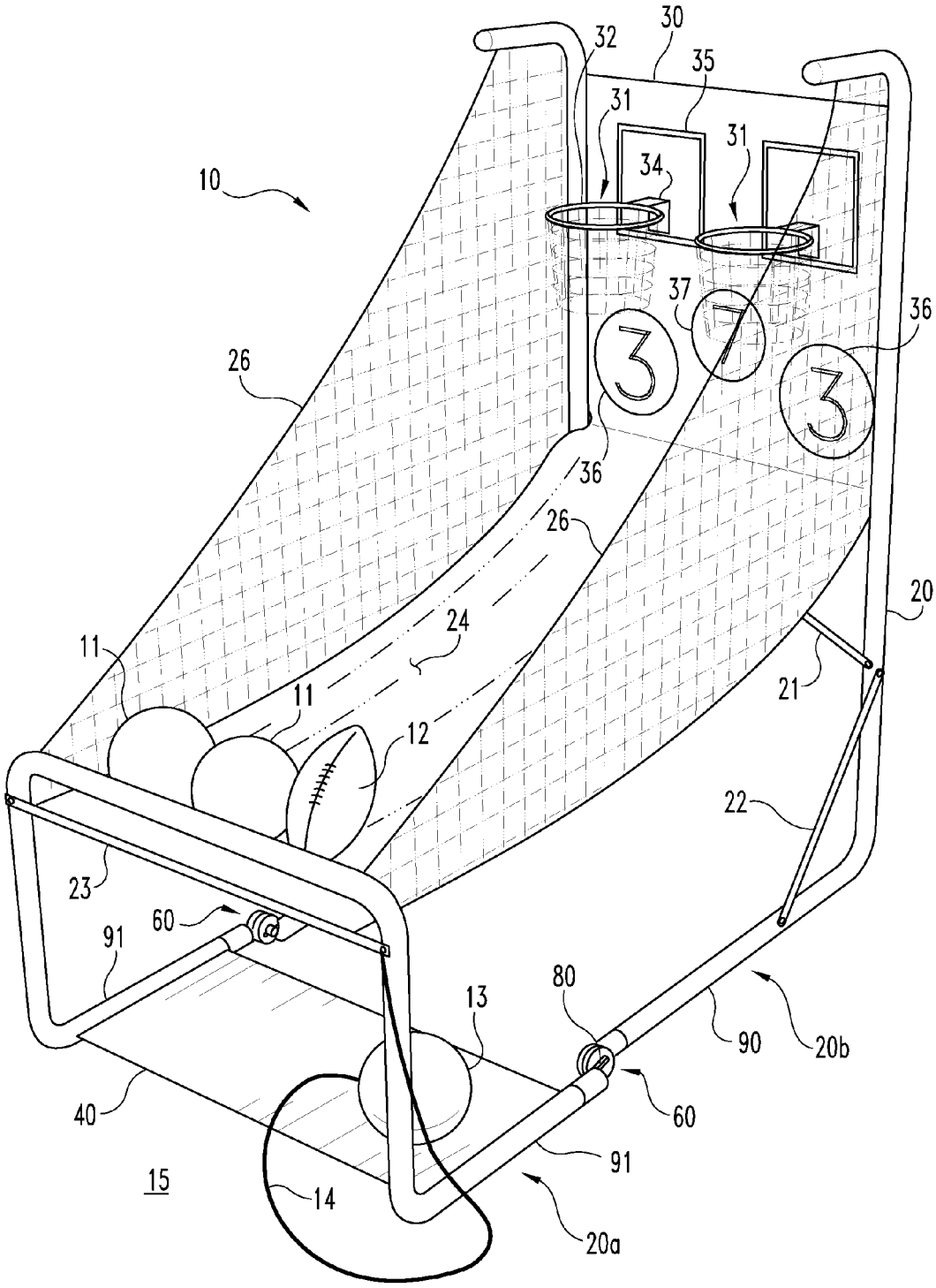
FIG. 1 is a perspective view of a convertible game assembly according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein are contemplated as would normally occur to one skilled in the art to which the invention relates.

The present disclosure provides a three-in-one convertible game assembly for passing, throwing and/or kicking projectiles, such as footballs, basketball, and/or soccer balls, where a player stands in a designated position and attempts to pass, throw and/or kick projectiles toward defined target areas. The convertible game assembly is configurable in at least two configurations, including an open configuration for playing football and basketball and a closed configuration for playing soccer. The convertible game assembly may include adjustable joints to allow for the game assembly to be converted between configurations. Additionally, in certain embodiments, the game includes means for detecting when a projectile triggers one of the designated target areas. In such embodiments, the game assembly may include a controller with an internal processor which receives signals from the target, determines the current status of the game via the signals and reflects that status on an electronic display and/or with audio signals.

Illustrated in FIG. 1 is a perspective view of a convertible game assembly according to the present disclosure. Convertible game assembly 10 includes a stand or frame 20. A player position 15 is spaced in front of frame 20 where a person stands during play. A back throwing target area or piece 30 is mounted to frame 20 and includes predefined basketball and football target areas. A front kicking target area or piece 40 is mounted to frame 20 and includes predefined soccer target areas. Game assembly 10 is configurable in both an open configuration (see FIG. 1) for throwing projectiles, such as footballs and basketballs, at elevated back target piece 30 and a closed configuration (see FIG. 2) for kicking projectiles, such as soccer balls, at front target piece 40. As illustrated, frame 20 may also include various cross bars, such as cross bars 21, 22 and 23, to assist in the support and proper positioning of assembly 10. It is contemplated that other cross bars may be included with game assembly 10, although they are not shown in the figures.

In certain embodiments, game assembly 10 may also include an electronic display (not shown) for showing the status of a game being played with assembly 10, for example such as the timing and scoring of the particular game. Additionally, a control box (not shown) may be operably connected to game assembly 10 for selecting various control functions and could include buttons for turning the power on/off, a pause (time-out) button, a game selector button, a timer control button, a game reset button, a score reset and/or adjust button, and/or other appropriate buttons as would occur to one skilled in the art.

As illustrated, basketballs 11 and football 12 may be used with game assembly 10 for throwing and passing toward back target piece 30. Apron 24 is mounted to the rear of frame 20 to catch projectiles thrown at the target areas and extends forward and downward from back target piece 30 to cross bar 23. Apron 24 may be mounted at an angle to allow a gravity feed to return the projectiles toward player position 15. In certain embodiments, the projectiles return to a resting position adjacent cross bar 23. Netting 26 may be mounted to the sides and/or top of frame 20 around back target piece 30 and apron 24 to prevent the projectiles from bouncing or escaping laterally or vertically.

Additionally, a soccer ball 13 may be used with game assembly 10 for kicking toward front target piece 40 in a closed configuration. In certain embodiments, tether 14 is used to connect soccer ball 13 with frame 20 and is preferably of a sufficient length to allow for kicking of soccer ball 13 toward front target piece 40. Basketballs 11, football 12, and soccer ball 13 may be of regulation types and configurations, or may be made of softer materials and/or reduced in size as appropriate for indoor, reduced scale game use.

Target pieces 30 and 40, apron 24 and/or nets 26 can be temporarily or permanently attached to frame 20 in various possible manners, including through the use of buckles, pins, clips, hooks, knots, clamps, bolts, screws or mounting brackets. In certain embodiments, target pieces 30 and 40, apron 24 and/or nets 26 may be selectively and releaseably securable to frame 20 to allow simple and optionally quick release mounting and disengaging of the game assembly, preferably without tools. In other embodiments, fasteners such as snaps or laces are used to connect the components of the game assembly together and maintain assembly thereof.

Back target piece 30 may include at least one basketball goal assembly 31 mounted thereon for receiving a projectile, such as a basketball 11. As illustrated, game assembly 10 can include two side-by-side basketball goal assemblies 31 for simultaneous play by two players. However, it should be appreciated that assembly 10 may include more or fewer than two basketball goal assemblies. Basketball goal assemblies 31 can be fixedly or adjustably mounted to back target piece 30 using various means known to those skilled in the art. In certain embodiments, each basketball goal assembly 31 includes a basketball goal hoop 32 mounted to back target piece 30 via a bracket or hoop mount 34 in target zone area 35. Hoop mount 34 may allow the hoop to pivot during use, for example with a biased or breakaway pivot hinge. A net 33 is typically suspended from hoop 32.

Additionally, back target piece 30 may include football target areas 36 and 37. In certain embodiments, target areas 36 and 37 are of varying sizes, such as target areas 36 being larger than target area 37. As illustrated, target areas 36 and 37 may be circular, with target areas 36 including a larger diameter than target area 37. The various sized football target areas may include score designations, such that the smaller target area 37 corresponds to an increased level of difficulty and reward if the projectile successfully strikes the target zone. Typically the larger target areas have the lowest difficulty and lowest reward. It is contemplated that the football target areas could number more or less than three in total and could include other shapes and sizes. Although the illustrated embodiment shows back target piece 30 being designed for both football and basketball, it should be appreciated that convertible game assembly 10 could be configured for playing only one of football or basketball when assembly 10 is in the open configuration. Alternatively, assembly 10 could be configured for playing other games such as tennis or volleyball when assembly 10 is in the open configuration, in addition to or in lieu of basketball and/or football.

Figure 2:
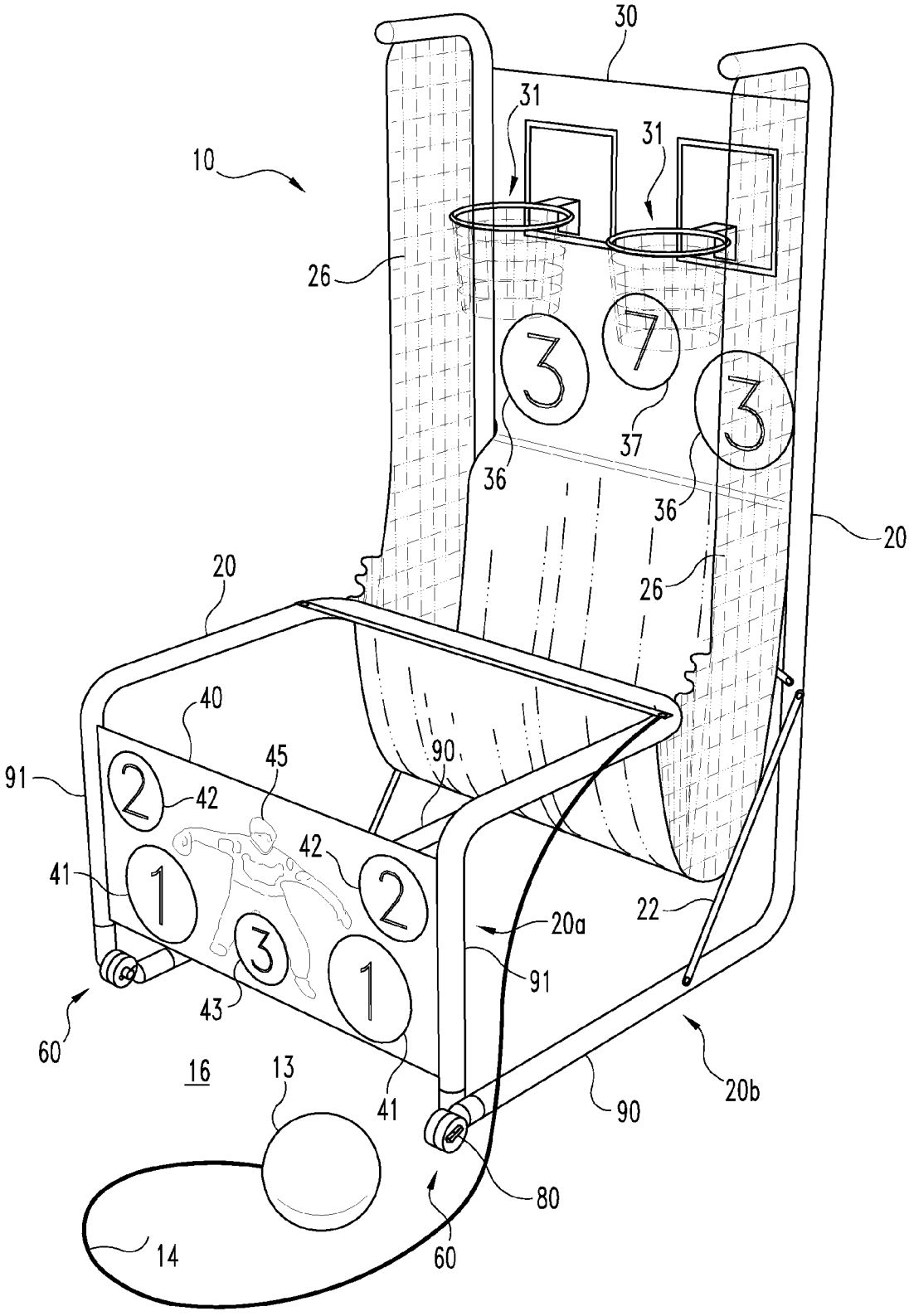
FIG. 2 is another perspective view of the convertible game assembly according to the embodiment shown in FIG. 1.

As illustrated in FIG. 2, front target piece 40 includes soccer target areas 41, 42 and 43. In certain embodiments, target areas 41, 42 and 43 are of various sizes, such as decreasing in size from target areas 41 down to target area 43. As illustrated, target areas 41, 42 and 43 may be circular, with target areas 41 including a larger diameter than target areas 42, and target areas 42 including a larger diameter than target area 43. The various sized soccer target areas may include score designations, such that the smaller target area 43 corresponds to an increased level of difficulty and reward if the projectile successfully strikes the target zone. Typically the larger target areas have the lowest difficulty and lowest reward. It is contemplated that the soccer target areas could number more or less than five in total and could include other shapes and sizes. Additionally, front target piece 40 may depict a soccer player 45 thereon or other decoration.

Convertible game assembly 10 may optionally include scoring sensors adjacent one or more of the basketball goal assemblies 31, football target areas 36 and 37 and/or soccer target areas 41, 42 and 43. In certain embodiments, the scoring sensors associated with basketball goal assemblies 31 are light sensors, each of which includes at least one aligned light beam emitter and a light beam receiver. Preferably, the light beam emitters generate light signals such as infrared light beams modulated at a frequency that can be detected by the corresponding detectors without interference from ambient light or accidentally activated by surrounding conditions. In such embodiments, each basketball goal assembly includes a sufficient number of light sensors spaced such that a projectile passing through the hoop of the basketball goal assembly will automatically intercept and break the beam of at least one light sensor emitter/receiver pair. When the projectile breaks a light beam, the sensor sends an appropriate signal to the controller that a projectile has been detected. Preferably, the light sensors are aligned and rigidly attached to the particular basketball goal assembly to prevent the need to move or adjust the light sensors when moving, assembling or disassembling game assembly 10. In certain other embodiments, mechanical sensors may be used with basketball goal assemblies 31 to send appropriate signals to the controller that a projectile has been detected.

In certain embodiments, the scoring sensors associated with football target areas 36 and 37 and soccer target areas 41, 42 and 43 may be impact sensors. Impact sensors are triggered when they detect an impact force against the target area. It is contemplated that sensors for missed or off target projectile passes, throws and/or kicks may also be incorporated into game assembly 10.

An electronic controller with an internal processor may be mounted to assembly 10 and operably connected to each of the scoring sensors and an electronic display. Standard wiring and plugs may be used to connect the scoring sensor components to the electronic controller, and a power source is used. For clarity, the electronic components of assembly 10 are not illustrated.

In certain embodiments, game assembly 10 is positionable in an open configuration (see FIG. 1) for playing football and basketball and a closed configuration (see FIG. 2) for playing soccer via adjustable joints 60. As illustrated in FIGS. 1 and 2, adjustable joints 60 are connected with frame 20, such that joints 60 divide frame 20 into a front or forward pivoting portion 20*a* and a back or rear base portion 20*b*. Front portion 20*a* is configured to pivot upward about adjustable joints 60 to convert the assembly from the open configuration to the closed configuration.

In the illustrated embodiment, back target piece 30 is connected with back portion 20*b* and front target piece 40 is connected with front portion 20*a*. Accordingly, in the open configuration, front target piece 40 is positioned substantially flat on the support surface when assembly 10 is in the open configuration (FIG. 1), but is rotated upward via the pivoting about joints 60 to be substantially perpendicular to the support surface when assembly 10 is in the closed configuration (FIG. 2).

Additionally, front portion 20*a* includes base frame sections 91 and back portion 20*b* includes base frame sections 90. In an open configuration, both sections 90 and 91 contact the support surface to support assembly 10. In a closed configuration, sections 91 are pivoted upward approximately 90 degrees about joints 60 toward back portion 20*b*, such that only sections 90 contact the support surface to support assembly 10. As illustrated in FIG. 2, the closed configuration defines a player position 16 spaced in front of frame 20 where a person stands during play, with player position 16 of the closed configuration (FIG. 2) being positioned closer to back portion 20*b* than player position 15 of the open configuration (FIG. 1).

Figure 3:
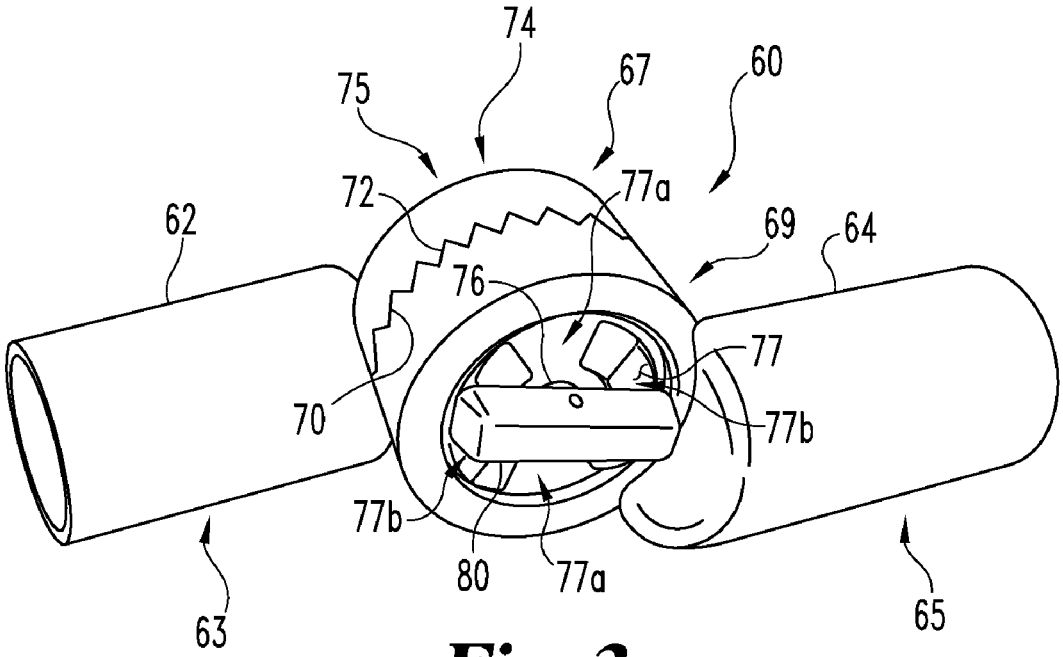
FIG. 3 is a perspective view of an adjustable joint of the convertible game assembly according to the embodiment shown in FIG. 1.
Figure 4:
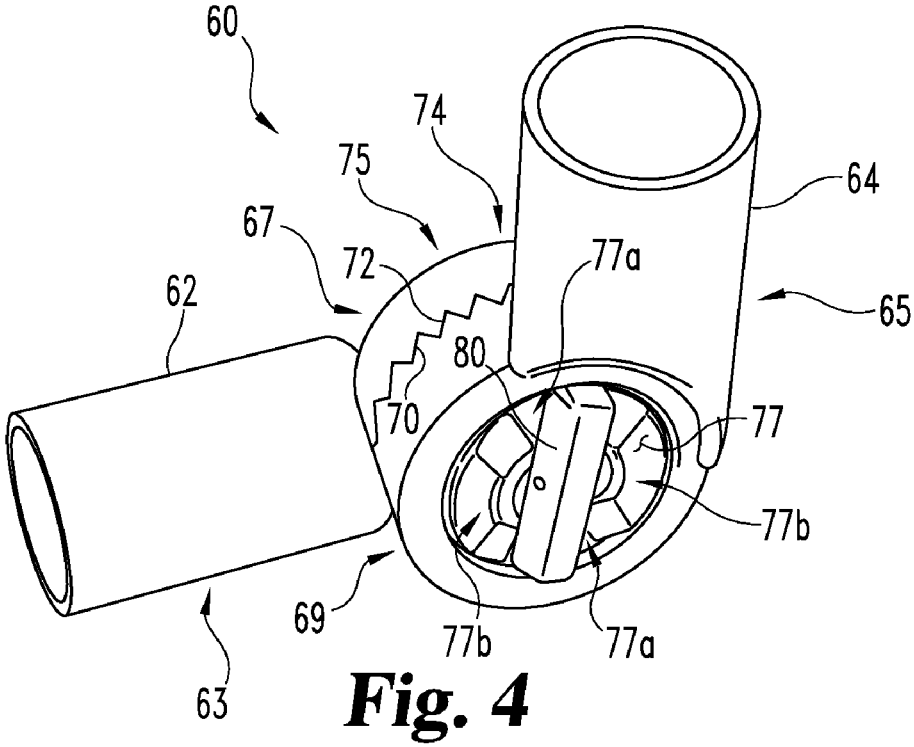
FIG. 4 is another perspective view of the adjustable joint of FIG. 3, of the convertible game assembly according to the embodiment shown in FIG. 1.

FIG. 3 illustrates an adjustable joint 60 according to an open configuration of game assembly 10, as illustrated in FIG. 1. FIG. 4 illustrates an adjustable joint 60 according to a closed configuration of game assembly 10, as illustrated in FIG. 2. In the illustrated embodiment, joint 60 includes two mating connection members 62 and 64 connected together via a pin 80. Pin 80 can be turned between locked and unlocked positions to adjust the relative angular or rotational positions of connection members 62 and 64, and thereby convert game assembly 10 between open and closed configurations. In an open configuration (see FIG. 3), connection members 62 and 64 are substantially planar, with the angular relationship between the connection members being around 180 degrees, while in a closed configuration (see FIG. 4), connection members 62 and 64 are substantially perpendicular, with the angular relationship between the connection members being around 90 degrees. However, it is contemplated that other appropriate adjustment mechanisms may be used to assist in converting the game assembly between open and closed positions.

Connection members 62 and 64 include extension portions 63 and 65, respectively, and connection portions 67 and 69, respectively. In certain embodiments, extension portions 63 and 65 are configured to engage or nest with rods of frame 20. Additionally, connection portions 67 and 69 of connection members 62 and 64 include inner splined surfaces 70 and 72 configured to engage each other and substantially prevent relative rotation of the connection members. Connection members 62 and 64 further include outer surfaces 75 and 77, respectively, and define holes 74 and 76, respectively, extending from the inner splined surfaces to the outer surfaces. Holes 74 and 76 are configured for passage of a post of a pin 80 having a handle 81 adjacent outer surface 77. In such embodiments, pin 80 is secured from retracting at the end opposite handle 81. In certain embodiments, a retaining clip (not shown) is utilized adjacent outer surface 75 to engage the distal end of the post of pin 80.

As illustrated, the outer surface 77 of connection portion 69 includes sloped and depressed portions 77*a* opposite raised portions 77*b*. In such embodiments, pin 80 may be turned or rotated such that handle 81 engages raised portions 77*b* to press the connection members together to substantially lock connection members 62 and 64 at a desired position. In such embodiments, when pin 80 is aligned with depressed portions 77*a*, splined surfaces 70 and 72 may be disengaged and the position of connection members 62 and 64 may be adjusted such that game assembly 10 may converted between the open and closed positions. Additionally, it is contemplated that outer surface 75 may also be sloped, in a similar manner as outer surface 77, with the pin including a handle engageable with raised portions of outer surface 75 to assist in locking the connection members together.

When playing the game, a player stands in front of game assembly 10 at player position 15. The player attempts to pass a projectile, such as basketball 11, through one of basketball hoops 32, or throw a projectile, such as football 12, toward one of target area 36 or 37, or kick a projectile, such as soccer ball 13, toward one of target area 41, 42 or 43. In embodiments in which sensors are used, when the particular projectile triggers the respective sensor, an appropriate signal may be sent to the controller and the game status may be updated on an electronic display. The player position distance may be increased to raise the difficulty level.

Simulated games of football and basketball may be played with game assembly 10 in an open position, as illustrated in FIG. 1. As desired, game assembly 10 may be converted to the closed position, as illustrated in FIG. 2, for playing a simulated game of soccer. Joints 60 may be adjusted to convert between the open and closed positions. In such embodiments, pin 80 may be turned such that if the pin is aligned with depressed areas 77*a* of outer surface 77 (as illustrated in FIG. 4), it allows freedom of movement between connection members 62 and 64. Accordingly, one or both of connection members 62 and/or 64 may be adjusted to create the desired relationship between the connection members, such as creating a substantially right angle therebetween to convert game assembly 10 to a closed position, or creating a substantially straight alignment between the connection members to convert game assembly 10 to an open position. Once the desired position of connection members 62 and 64 is reached, pin 80 may be turned such that pin 80 is aligned with raised areas 77*b*, pressing the connection members together and substantially locking adjustable joint 60 at the desired position.

Game assembly 10 can be manufactured and assembled from standard materials. For example, frame 20 may be plastic or metal such as aluminum or steel. Frame 20 may be made from modular, hollow metal tubing with nestable ends for connectivity. Additionally, apron 24, target pieces 30 and 40, and/or nets 26 may be made from a vinyl, canvas, nylon, leather, plastic, other synthetic materials, or other such appropriate material composition. Apron 24 and/or target pieces 30 and/or 40 may be decorated with various indicia to gain attention and/or reflect a preferred team colors. The projectiles used in connection with game assembly 10 may be standard or reduced sized. In certain embodiments, the overall size of game assembly 10 is sized to fit within a room with a standard eight foot ceiling. Additionally, in certain embodiments, game assembly 10 may be portable and/or disassemblable.

In certain embodiments, game assembly 10 is manufactured to include modular, lightweight components to enhance the ease of transport, assembly and disassembly. Game assembly 10 can be stored and shipped in a relatively flat, palette sized box. Additionally, in certain embodiments, game assembly 10 requires slight assembly, preferably without the use of tools. In certain other embodiments, game assembly 10 arrives assembled.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A convertible game assembly, comprising:

a convertible frame having a back frame portion and a front frame portion and at least one adjustable joint separating said back and front frame portions, wherein said front frame portion is configured to pivot upward about said adjustable joint toward said back frame portion to convert said frame from an open configuration to a closed configuration;

an elevated back target piece coupled to said back frame portion;

a front target piece coupled to said front frame portion;

wherein said frame is positionable in the open configuration to allow a game player to throw projectiles toward said back target piece, said open configuration defining a first player position in front of said front frame portion; and wherein said frame is positionable in the closed configuration to allow a game player to kick projectiles toward said front target piece, said closed configuration defining a second player position in front of said front frame portion and closer to said back frame portion than the first player position.

2. The assembly of claim 1, wherein said front frame portion includes at least one base section for contacting a support surface when said frame is in said open configuration, wherein said base section of said front frame portion is configured to pivot about said adjustable joint toward said back frame portion to position said frame in said closed configuration.

3. The assembly of claim 1, wherein said front target piece is planar, wherein said front target piece is positioned substantially flat on a support surface when said frame is positioned in said open configuration and wherein said front target piece is positioned substantially perpendicular to the support surface when said frame is positioned in said closed configuration to expose said front target piece to receive kicked projectiles.

4. The assembly of claim 1, further comprising at least one basketball goal assembly coupled to said back target area.

5. The assembly of claim 4, wherein said basketball goal assembly includes a basketball hoop, a basketball net hanging from said hoop, and a hoop mount for mounting said basketball hoop to said back target piece.

6. The assembly of claim 5, wherein said basketball goal assembly includes at least one scoring sensor for indicating passage of a basketball through said basketball hoop.

7. The assembly of claim 1, further comprising at least one football target area on said back target piece, wherein said at least one football target area includes a score designation.

8. The assembly of claim 7, further comprising at least one impact scoring sensor on said football target area.

9. The assembly of claim 1, further comprising at least one soccer target area on said front target piece, wherein said at least one soccer target area includes a score designation.

10. The assembly of claim 9, further comprising a soccer ball and a tether having a first end coupled to said front frame portion and a second end coupled to said soccer ball.

11. The assembly of claim 1, wherein said adjustable joint includes first and second mating connection members and a connecting pin for locking said mating connection members together at desired rotational positions, wherein said first mating connection member is configured to engage said back frame portion and said second mating connection member is configured to engage said front frame portion.

12. The assembly of claim 11, wherein each of said connection members includes a splined mating surface for engaging the other of said connection members at selected angular positions.

13. The assembly of claim 11, wherein an angle between said connection members is about 180 degrees when said frame is positionable in said open configuration and about 90 degrees when said frame is positionable in said closed configuration.

14. A convertible game assembly, comprising:

a convertible frame configured to convert between a first configuration for playing a throwing game and a second configuration for playing a kicking game, said first configuration being different from said second configuration, wherein said frame includes a rear base portion and a forward pivoting portion;

a throwing target area engaged with said rear base portion of said frame;

a kicking target area engaged with said forward moveable portion of said frame, said second target area being different from said first target area;

wherein said frame is positionable in said first configuration for a player to play the throwing game utilizing said throwing target area; and wherein said frame is positionable in said second configuration by pivoting said forward pivoting portion to orient said kicking target area for a player to play a kicking game.

15. The assembly of claim 14, wherein said frame includes at least one pivot joint separating said rear and forward portions, wherein said pivot joint is adjustable to convert said frame between said first and second configurations.

16. The assembly of claim 14, wherein said throwing target area includes at least one basketball goal and said kicking target area includes at least one soccer target.

17. A system, comprising:

a convertible game assembly for converting between at least one kicking game and at least one throwing game;

wherein said assembly includes a convertible frame having two adjustable side joints to convert said frame between throwing and kicking game-playing configurations, wherein said frame includes a back base frame portion and a front pivoting frame portion, with said adjustable side joints positioned between and separating said front and back frame portions;

wherein said assembly includes a throwing target area engaged with said back base frame portion and having at least one of a basketball goal and a football target for use in playing basketball or football, respectively, when said frame is positioned in said throwing game-playing configuration; and, wherein said assembly includes a kicking target area engaged with said front pivoting frame portion and having at least one soccer target for use in playing soccer when said frame is positioned in said kicking game-playing configuration.

18. The system of claim 17, wherein each of said adjustable joints includes two mating connection members and a connecting pin for locking said mating connection members together at desired rotational positions, wherein each of said connection members includes a splined mating surface for engaging with the other of said connection members at selected angular positions.

19. The assembly of claim 17, wherein said kicking target area is planar, wherein said kicking target area is positioned substantially flat on a support surface when said frame is positioned in said throwing game-playing configuration and wherein said kicking target area is positioned substantially perpendicular to the support surface when said frame is positioned in said kicking game-playing configuration to expose said kicking target area to receive kicked projectiles.

20. The system of claim 17, wherein said throwing target area includes both a basketball goal assembly and a football target for use in playing basketball and football respectively.

* * * * *